US006530720B1

(12) United States Patent
Green

(10) Patent No.: US 6,530,720 B1
(45) Date of Patent: Mar. 11, 2003

(54) TRANSDUCER ARRANGEMENT FOR SCREED CONTROL

(75) Inventor: Francisco Roberto Green, Dayton, OH (US)

(73) Assignee: Trimble Navigation Limited, Sunnyvale, CA (US)

( * ) Notice: Subject to any disclaimer, the term of this patent is extended or adjusted under 35 U.S.C. 154(b) by 0 days.

(21) Appl. No.: 09/492,061

(22) Filed: Jan. 27, 2000

Related U.S. Application Data

(60) Provisional application No. 60/118,085, filed on Jan. 27, 1999.

(51) Int. Cl.[7] ..... E01C 23/07
(52) U.S. Cl. ..... 404/84.1; 404/84.5
(58) Field of Search ..... 404/84.05, 84.1, 404/84.5, 84.8; 33/290, 291, 293, 286, 276, 285, 281, 282, 295, DIG. 21, 624, 645; 356/4.08; 172/4, 4.5, 5, 795

(56) References Cited

U.S. PATENT DOCUMENTS 4,025,194 A * 5/1977 Teppo ..... 356/5
4,559,445 A * 12/1985 Hedin et al. ..... 250/203
4,655,633 A 4/1987 Somero et al.
4,752,156 A * 6/1988 Owens ..... 404/118
4,930,935 A 6/1990 Quenzi et al.
4,978,246 A 12/1990 Quenzi et al.
5,039,249 A 8/1991 Hansen et al.
5,098,185 A * 3/1992 Watanabe et al. ..... 356/5
5,288,166 A 2/1994 Allen et al.
5,288,167 A * 2/1994 Gaffard et al. ..... 404/84.05
5,556,226 A * 9/1996 Hohmann, Jr. ..... 404/84.1
5,771,978 A * 6/1998 Davidson et al. ..... 172/4.5
6,171,018 B1 * 1/2001 Ohtomo et al. ..... 404/84.5
6,227,761 B1 * 5/2001 Kieranen et al. ..... 404/84.5

* cited by examiner

*Primary Examiner*—Thomas B. Will
*Assistant Examiner*—Raymond W. Addie
(74) *Attorney, Agent, or Firm*—Killworth, Gottman, Hagan & Schaeff LLP

(57) ABSTRACT

A transducer arrangement and method that generates control signals indicating relative positions of the ends of a hydraulically movable screed head. The generated control signals of the present invention are used by a conventional control circuit controlling the hydraulically movable screed head with laser receivers in a column block situation, which interrupts the reception of a laser beam from a laser transmitter by one of the laser receivers, to provide an estimated absolute position of the interrupted receiver side of the screed head until the column block situation clears. Normally, absolute measurements are available on both sides of the screed head via the laser receivers receiving the laser beam. The transducer arrangement of the present invention provides an additional control signal that in a column blocked situation the control system uses to maintain a relative elevation position of the interrupted receiver side to the absolute position of the uninterrupted receiver side until both receiver can reacquire the elevational reference of the laser transmitter.

6 Claims, 1 Drawing Sheet

TRANSDUCER ARRANGEMENT FOR SCREED CONTROL

CROSS-REFERENCE TO RELATED APPLICATIONS

This application claims the benefit of U.S. Provisional Application No. 60/118,085, filed Jan. 27, 1999, which is incorporated herein by reference.

BACKGROUND OF THE INVENTION

The present invention relates to a transducer arrangement for screed control, and more specifically, to a screed control system of a screed head carried by a machine having laser receivers receiving actual elevational positions of the ends of the screed head from an external laser transmitter, and a transducer arrangement providing relative elevational positions of the ends of the screed head to each other.

In using a screed machine for screeding applications, typically, a hydraulic cylinder is connected at each end of a screed head to raise or lower each end of the screed head independently. Accordingly, the two sides of the screed head must be controlled. This is done presently by attaching a pair of laser receivers, one to each side, to the screed head. The elevation feedback provided by the pair of laser receivers drives the hydraulics controlling the elevation of each side of the screed head.

The elevational feedback of each end of the screed head is based upon the pair of laser transmitter detecting a rotating reference beam of laser light that defines a reference plane. This reference plane, emitted by a laser transmission, thus indicates a designated elevation. During a screeding operation, each of the receivers provide elevation feedback to drive the hydraulics controlling the elevation of each side of the screed head in order to maintain the elevational reference.

A problem may arise, however, if the reception of the elevational reference by one the receivers is blocked or interrupted by something of an appreciable height, such as, for example, a support column in a building, or is disrupted. When a blockage or interruption occurs, there is a need to maintain the relative elevation of the ends of the screed head until the elevational reference can be reacquired by both receivers. There is also a need to be able to pull the screed head along a straight path, while maintaining the chosen thickness of the layer and matching forms or existing surfaces during the screeding operation.

One approach to this problem is to set up two external laser transmitters at the same elevation on opposite sides of the screed head. In this way, if a column blocks one of the laser transmitters, the other external laser transmitter is likely to be illuminating the laser receivers at the ends of the screed head, thereby compensating for the interruption. Essentially, the prior art method is to eliminate all blind spots around the receivers. However, this prior art method adds an additional cost in providing and setting up the second external laser transmitter in order to eliminate the possibility of a column block situation.

Another approach to this problem is to use a gravity-based cross slope sensor, which detects the angular shifts of the screed head as the screed head tilts up and down. Additionally, the gravity-based cross slope sensor may be used as a reference for set up and control in a super flat, or plumb, floor application. Accordingly, when both sides of the screed head are within the appropriate dead band, the desired grade of the cross slope sensor is measured and stored in memory of the screed head's control system. When one laser receiver loses reception of the elevational reference, the cross slope sensor detects the height of the interrupted receiver side of the screed head relative to its uninterrupted receiver side. That is, the cross slope sensor provides a relative measurement of the interrupted laser receiver which, when coupled with the absolute measurement of the uninterrupted laser receiver, provides an estimate of the absolute position of the interrupted laser receive. The control system of the screed head uses the provided absolute and estimated absolute positions to control the elevation of ends of the screed head. However, several disadvantages exist in the cross slope sensor arrangement described above.

First, the gravity-based cross slope sensor is vulnerable to accelerations along its sensitive axis, resulting in miscalculations of the screed head's slope. In screeding operations, it is quite common for the operator to 'side shift' the screed head around columns as he pulls the screed head back. Since the sensitive axis of the gravity-based cross slope sensor is parallel to the length of the screed head, this side shifting can cause noticeable acceleration along the sensitive axis of measurement, thus dramatically affecting the feedback of the cross slope sensor. Second, harmonics of the machine boom carrying the screed head, which do not cause significant enough elevation shifts to be seen in the laser receivers at both ends of the screed head, are detectable by gravity-base cross slope sensor since it measures acceleration and not machine movement. Third, in order to reduce the effects of noise and to compensate for some of the low frequency harmonics of the machine vibration, considerable lowpass filtering of the cross slope sensor is required. The use of low pass filters on the output of the gravity-based cross slope sensor adds an inherent time lag to the system, which degrades the bandwidth performance of the blocked side. Finally, separate control gains for the cross slope sensor are used to compensate for the time lag. Additionally, changes in loop gain is required to accommodate angular and positional feedback.

Therefore, there is a need for providing a screed control system that does not require setting up a second external laser transmitter in order to maintain the elevation of the ends of the screed head in a block receiver situation.

There is also a need for providing a screed control system that does not require a gravity-based cross slope sensors to maintain the relative elevation of the blocked receiver end of the screed head until the elevation reference can be reacquired by both receivers.

SUMMARY OF THE INVENTION

These needs are met by a transducer arrangement according to the present invention that generates control signals indicating relative positions of the ends of the screed head. The control signals of the present invention can be use by the conventional control circuit in a column block situation, which interrupts the reception of a laser beam, providing an elevational reference, from a laser transmitter by one of the laser receivers, to provide an estimated absolute position of the interrupted receiver side until the column block situation clears. Normally, as pointed out above, absolute measurements are available on both sides of the screed head via the laser receivers. Thus, in the present invention, the key to controlling the screed head in a column blocked situation is that at any given time, at least one absolute measurement for one side of the screed head and one relative elevational measurement from that side of the screed head to the blocked side of the screed head is available to the control system. Accordingly, with the generated control signals from the transducer arrangement of the present invention the control system can maintain a relative elevation position of the interrupted receiver side to the absolute position of the uninterrupted receiver side until both receiver can reacquire the elevational reference of the laser transmitter.

In one aspect, the present invention is a transducer arrangement for generating control signals used by a conventional control circuit, which controls movement of hydraulically controlled ends of a screed head with laser receivers provided at the ends, in a column block situation that interrupts the reception of a laser beam, defining a chosen elevational position, from a laser transmitter by one of the laser receivers so as to maintain the chosen elevational position of each hydraulically controlled end of the screed head, the transducer arrangement comprising a light source mounted on a first mast of the screed head; and a light detection device mounted on a second mast of the screed head, the light detection device includes a plurality of light detectors vertically arranged and associated electronics to provide an output to the conventional control circuit indicating which of the plurality of light detectors is illuminated by light from the light source thereby providing an indication of the relative height of the first and second masts, and therefore of the relative height of the ends of the screed head until the column block situation clears.

In another aspect, the present invention is a method of controlling elevational positions of hydraulically controlled ends of a screed head in relationship to a reference plane, defined by a laser transmitter and detected by laser receivers attached the end of the screed head, in a column block situation that interrupts the reception of a laser beam from the laser transmitter by one of the laser receivers, comprising the steps of emitting light from a light source mounted on a first mast of the screed head; detecting the light with a light detection device mounted on a second mast of the screed head, the light detection device includes a plurality of light detectors arranged in a vertical row; generating an output indicating which of the plurality of light detectors is illuminated by light from the light source; and using the output of the light detection device to maintain a relative height between the first and second mast until the column block situation clears.

DETAILED DESCRIPTION OF THE PREFERRED EMBODIMENT

Figure 1:
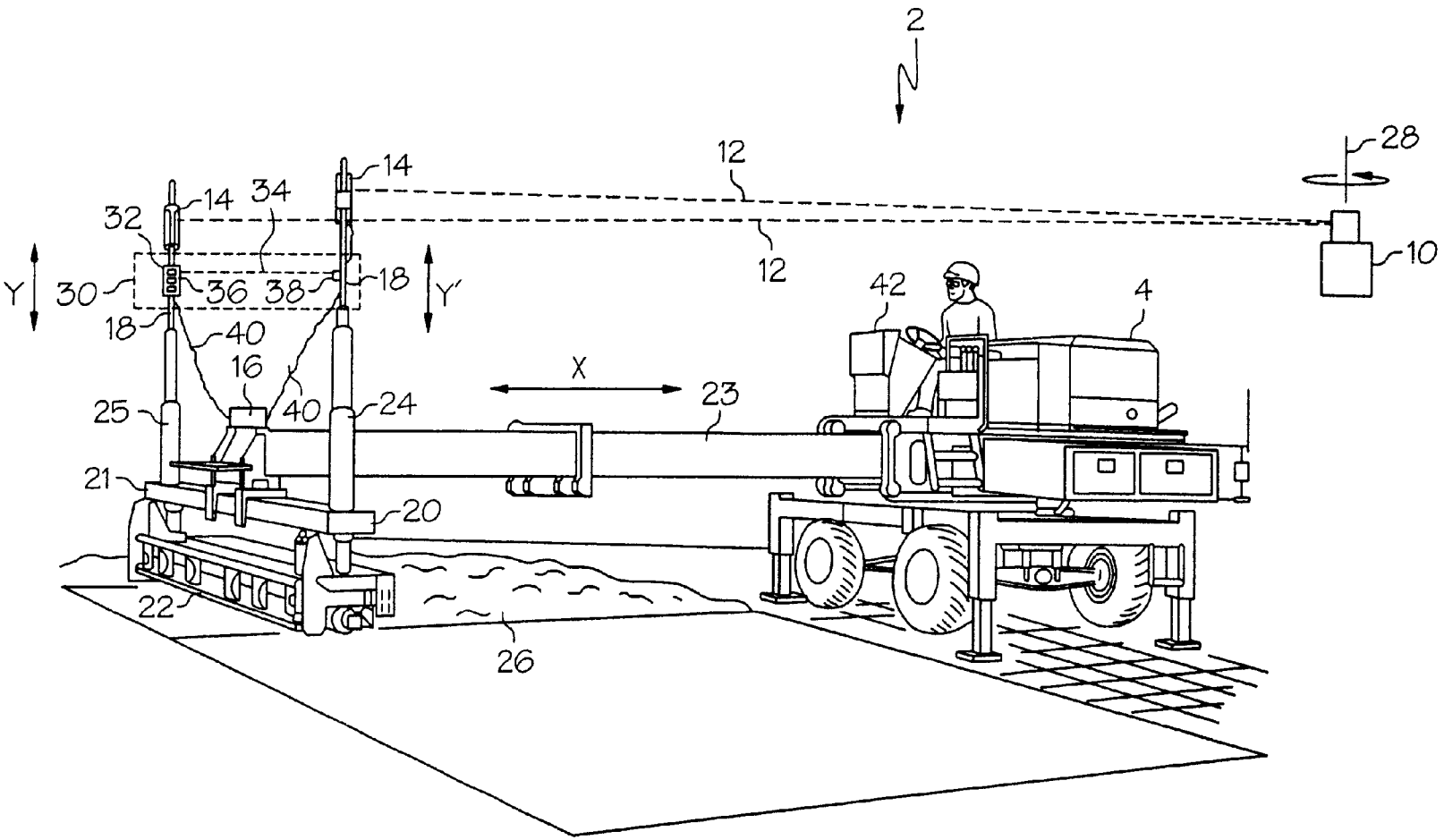
FIG. 1 illustrates a screeding operation and the control arrangement of the present invention.

As illustrated generally in FIG. 1, a conventional screed control systems 2 for a screed machine 4 typically consist of an external laser transmitter 10, transmitting a rotating laser beam 12, a pair of laser receivers 14, a control box 16 for controlling electro-hydraulic control values (not shown) of the screed machine 4. The screed machine 4 further includes a pair of masts 18, each carrying one of the pair of laser receivers 14, attached with and moved generally vertically, independently, with respective ends 20 and 21 of a screed head 22. The screed head 22 is attached to the end of a hydraulic arm or boom 23 which moves the screed head 22 in the horizontal direction x. During normal operation, the control box 16 causes actuation of the hydraulic valves such that hydraulic cylinders 24 and 25 at the ends 20 and 21, respectively, independently raise or lower, indicated by vertical directions y and y', the ends 20 and 21 of the screed head 22, as needed, as it is drawn in the direction of x over the surface of uncured concrete 26. It is to be appreciated that the raising and lowering of the screed head 22 in the vertical directions y and y' is accomplished in response to reception of the reference laser beam 12 by the pair of laser receivers 14. The laser beam 12 rotates about an axis, as indicated at 28, so as to define a reference plane of laser light.

As discussed above, a difficulty arises with the conventional screed control system 2 of this type when the path of the laser beam 12 to one of the pair of receivers 14 is temporarily blocked by a column or other obstruction at a work site. In the present invention, a transducer arrangement, indicated generally by 30, is provided to over come the above mention difficulties with the conventional screed control system 2. The transducer arrangement 30 consists of two additional components or parts. Preferably, the two additional components are mounted directly underneath the pair of laser receivers 14 in order to reference movement from one side of the screed head 22 to the other. Alternatively, the two additional components could be includes as additional components or parts of the laser receivers. The first component of the transducer arrangement 30 is a light detection device 32, and basically consists of any conventional device that has the sufficient electronics to detect a reference light beam 34, such as a laser, and to output a feedback signal indicating the light beam's relative position detected. In the preferred embodiment, light detection device 32 includes a plurality of photo cells 36 arranged in a vertical row, or alternatively, split cells. Additionally, the light detection device 32 includes the associated electronics to provide an output indicating which of the photo cells 36 is illuminated by light beam 34 from the second component, a light source 38. The light source 38, and is preferably a laser transmitter, such as striped laser or alternatively, any other non-coherent light sources, such as a flash light. The light source 38 is mounted on the other side of the screed head 22 so that the reference light beam 34 it generates hits the photo cells 36 of the light detection device 32 on the other side of the screed head. Accordingly, the light source 38 projects the light beam 34 toward the light detection device 32 for illumination of one of the plurality of photo detectors 36. Since the light beam 34 only diverges slightly in the horizontal direction x, the criticality of the alignment of the light source 38 is greatly reduced. The transducer arrangement 30, in a similar manner as the pair of laser receivers 14, is electrical coupled to the control system 16 via electrical lines 40, which also provides power to the light source 38. Thus, after an initial calibration, the transducer arrangement 30, via one of the electrical lines 40, provides to the control system 16 an output signal, which indicates the relative height between the pair of masts 18.

The control system 16 uses the output signal of the transducer arrangement 30 to determine and therefore control the relative height of the two ends 20 and 21 of the screed head 22 when one of the normally absolute measurements provided by the pair of laser receivers 14 is unavailable due to a column block situation. In the column block situation, where reception of the laser beam 12 from the laser transmitter 10 by one of the pair of laser receivers 14 is disrupted, the control system maintains the relative elevational position of the blocked side end 20 or 21 to the actual elevational position of the unblocked side end until the laser beam 12 can be reacquired by both pairs of laser receivers 14.

The present invention provides a number of advantages. First, since the transducer arrangement 30 measures true movement and not just acceleration, it is not as vulnerable to possible machine vibration as would be the case with a gravity-based cross slope sensor. Essentially, the transducer arrangement 30 is no more sensitive to machine vibration than the pair of laser receivers 14. As a consequence, extensive lowpass filtering of the output signal from the transducer arrangement 30 at low frequencies is not needed. Hence, the light detection device 32 of the transducer arrangement 30 induces no appreciable time lag in it output signal into the control system 16, and thus is not limited to being sampled at 10 Hz, as is with the pair of conventional laser receivers 14. If desired, the output signal of the transducer arrangement 30 may be sampled at a much higher rate and low pass filtered into a 10 Hz signal to eliminate aliasing in the control system 16 and to provide the control system 16 with a signal that mimics the behavior of a laser receiver. Additionally, the output of the sensor is provided in the same units as the output of a laser receiver. As a consequence, the control feedback loop in the control system 16 uses the same gains with the feedback from the light detection device 32 as it does with the pair of laser receiver 14, therefore requiring no special calibration adjustments to maintain performance. Further, a user display 42 of the control system 16, easily communicates with the transducer arrangement 30 for modes of operation where adjusting the elevation of the blocked side is desired (i.e. an indicate mode). Finally, the present invention is not vulnerable to errors being induced by lateral shifting of the screed head.

What is claimed is:

1. A method of controlling elevational positions of hydraulically controlled ends of a screed head in relationship to a reference plane, defined by a laser transmitter and detected by laser receivers attached the end of the screed head, in a column block situation that interrupts the reception of a laser beam from the laser transmitter by one of the laser receivers, comprising the steps of:

(a) emitting light from a light source mounted on a first mast of the screed head;

(b) detecting said light with a light detection device mounted on a second mast of the screed head, said light detection device includes a plurality of light detectors arranged in a vertical row;

(c) generating an output indicating which of said plurality of light detectors is illuminated by light from said light source; and (d) using said output of said light detection device to maintain a relative height between said first and second mast until the column block situation clears.

2. A control arrangement for maintaining first and second opposed hydraulically controlled ends of a screed head at a chosen elevational position defined by an external laser reference, said control arrangement comprising:

a control circuit, a pair of laser receivers mounted on the screed head and one of each said pair of laser receivers provided adjacent one of the first and second opposed hydraulically controlled ends, said pair of laser receivers are adapted to provide control signals indicating measurements to the external laser reference to said control circuit, said control circuit is adapted to use said control signals to control individual movement of the first and second opposed hydraulically controlled ends of the screed head to maintain the chosen elevational position;

a light source mounted on the screed head and provided adjacent the first opposed hydraulically controlled end; and a light detection device mounted on the screed head and provided adjacent the second opposed hydraulically controlled end, said light detection device adapted to detect light from said light source and to provide an output to said control circuit, said output of said light detection device is an indication of relative height between the first and second opposed hydraulically controlled ends, said control circuit is adapted to use said output from said light detection device when reception of the external laser reference by one of said pair of laser receivers is disrupted so as to maintain the relative height between the first and second opposed hydraulically controlled end, and said control circuit is adapted to use said output until the external laser reference can be reacquired by said pair of laser receivers.

3. The control arrangement of claim 2 wherein said light source is selected from the group consisting of a laser, and a non-coherent light source.

4. The control arrangement of claim 2 wherein said plurality of light detectors is selected from the group consisting of photocells and split cells.

5. The control arrangement of claim 2 wherein said light source and said light detection device are components of a respective one of said pair of laser receivers.

6. The control arrangement of claim 2 wherein said light detection device comprises a plurality of light detectors vertically arranged and associated electronics adapted to provide said output to the control circuit indicating which of said light detectors is illuminated by the light from said light source.

* * * * *